US009022004B2

(12) United States Patent
Hara et al.

(10) Patent No.: US 9,022,004 B2
(45) Date of Patent: May 5, 2015

(54) FOUR-STROKE ENGINE

(71) Applicants: Akihiro Hara, Shizuoka (JP); Toshiaki Tanaka, Shizuoka (JP); Tetsuya Hasegawa, Shizuoka (JP)

(72) Inventors: Akihiro Hara, Shizuoka (JP); Toshiaki Tanaka, Shizuoka (JP); Tetsuya Hasegawa, Shizuoka (JP)

(73) Assignee: Makita Corporation, Aichi (JP)

( * ) Notice: Subject to any disclaimer, the term of this patent is extended or adjusted under 35 U.S.C. 154(b) by 251 days.

(21) Appl. No.: 13/688,289

(22) Filed: Nov. 29, 2012

(65) Prior Publication Data

US 2013/0160728 A1 Jun. 27, 2013

(30) Foreign Application Priority Data

Dec. 22, 2011 (JP) ..... 2011-282302

(51) Int. Cl.

| | |
|---|---|
| ***F01M 1/02*** | (2006.01) |
| ***F01M 1/04*** | (2006.01) |
| ***F01M 1/06*** | (2006.01) |
| ***F01M 11/06*** | (2006.01) |
| ***F01M 13/00*** | (2006.01) |

(52) U.S. Cl.

CPC . *F01M 1/04* (2013.01); *F01M 1/06* (2013.01); *F01M 11/065* (2013.01); *F01M 13/00* (2013.01)

(58) Field of Classification Search

USPC ..... 123/90.33, 90.34, 90.39, 90.4, 196 R, 123/572–574; 184/6.9, 6.26

See application file for complete search history.

(56) References Cited

U.S. PATENT DOCUMENTS

| | | | | |
|---|---|---|---|---|
| 5,975,042 | A | 11/1999 | Aizawa et al. | |
| 2001/0045199 | A1 * | 11/2001 | Nagai et al. | 123/196 R |
| 2005/0022775 | A1 | 2/2005 | Aronsson et al. | |
| 2005/0145215 | A1 | 7/2005 | Emanuelsson et al. | |
| 2009/0013959 | A1 * | 1/2009 | Lin | 123/196 M |
| 2011/0067669 | A1 | 3/2011 | Sugiyama et al. | |

FOREIGN PATENT DOCUMENTS

| | | | | |
|---|---|---|---|---|
| EP | 0887520 | | 12/1998 | |
| EP | 2305972 | | 4/2011 | |
| JP | 2002276321 | A * | 9/2002 | F01M 1/06 |
| JP | 2004-251231 | | 9/2004 | |
| JP | 2011-69240 | | 4/2011 | |
| WO | 03064826 | | 8/2003 | |

OTHER PUBLICATIONS

Search report from E.P.O., mail date is Mar. 1, 2013.

* cited by examiner

*Primary Examiner* — Hung Q Nguyen

(74) *Attorney, Agent, or Firm* — Greenblum & Bernstein, P.L.C.

(57) ABSTRACT

A four-stroke engine is provided to lubricate driving parts including a crankshaft and valve operating members while circulating oil, using pressure fluctuation in a crank chamber, the pressure fluctuation being caused by reciprocating motion of a piston. A cam driving parts move with rotation of the crankshaft; a driving chamber and a rocker chamber are connected to one another; the rocker chamber is connected to the crank chamber and a gas-liquid separator; the oil accumulated in a tank is sucked up into the crank chamber and circulated through each part of the four-stroke engine; the crank chamber and the driving chamber are connected to one another via a communicating passage and a return passage; and the crank chamber and the driving chamber connected to one another via the return passage communicate with one another only when the piston is located in a vicinity of the top dead center.

17 Claims, 12 Drawing Sheets

FOUR-STROKE ENGINE

CROSS-REFERENCES TO RELATED APPLICATIONS

This application claims the benefit of Japanese Patent Application No. 2011-282302, filed on Dec. 22, 2011, the entire contents of which are incorporated herein by reference.

BACKGROUND

1. Technical Field

The present invention relates to a four-stroke engine, and more specifically to a lubricating technology for a four-stroke engine mounted in a portable working machine such as a concrete cutter or a backpack working machine such as a mist blower.

2. Related Art

Lubrication apparatuses as disclosed in, for example, Japanese Patent Application Laid-Open No. 2004-251231 and Japanese Patent Application Laid-Open No. 2011-069240 have been known, which are used in a four-stroke engine mounted in a working machine.

The lubrication apparatus disclosed in JP2004-251231 performs oil circulation as follows: sucking up the oil accumulated in the oil tank into the crank chamber to lubricate the crank chamber; directly supplying the oil to the cam gear and the rocker arm to lubricate them; and returning the oil to the oil tank. This type of lubrication apparatus directly supplies oil from the crank chamber to valve operating members such as cam gears, and therefore the performance of lubricating the valve operating members can be kept. On the other hand, since a large amount of oil needs to be circulated, problems may occur in a gas-liquid separator that separates oil from blowby gas. The oil for lubrication is reused while being prevented from deteriorating through the following process: first, liquefying oil mist and separating the liquefied oil from blowby gas; delivering the separated blowby gas to a combustion chamber; and collecting the liquefied oil into the lubrication apparatus. Here, if too much oil is circulated, oil together with blowby gas supplied from the gas-liquid separator to the combustion chamber. This causes oil to be consumed quickly. When this type of engine is turned around in different directions in use, it promotes oil consumption, and therefore is not suitable for use in a portable working machine. In addition, this type of engine has advantages when used in a stationary or in-vehicle working machine, but not suitable for use in a portable working machine.

Meanwhile, the lubrication apparatus disclosed in JP2011-069240 performs oil circulation as follows: sucking up the oil accumulated in the oil tank into the crank chamber to lubricate the crank chamber; turning the oil into oil mist; collecting the oil mist in the oil tank once to reduce the concentration of the oil mist; and supplying the oil mist with the reduced concentration to valve operating members to lubricate the valve operating members. This type of lubrication apparatus circulates oil mist with a reduced concentration, and therefore exhibits good performance of a gas-liquid separator that separates oil from blowby gas. Therefore, it is very useful to save oil consumption. On the other hand, the performance of lubricating the valve operating members is not good, and therefore it is not suitable for use in a large working machine that is required to output high power. A cam has been commonly used as a valve operating member. However, the cam is particularly prone to be worn among valve operating members, and therefore high lubrication performance is required. A large engine cannot easily release heat, and therefore, if the temperature rises, the viscosity of the oil adhering to the driving parts decreases. This may cause oil depletion. If the performance of lubricating the driving parts degrades, friction is created. This causes the driving parts to be damaged quickly. This type of engine has a small displacement of 40 cc or less, and is particularly advantageous when used in a small portable working machine that is turned around in different directions in use, such as hedge trimmer, a chain saw, an olive harvester and so forth.

This type of engine is advantageous when used in a small portable working machine, but is not suitable for a large working machine.

However, a four-stroke engine having a displacement of 50 cc or more is being used in a portable working machine and a backpack working machine. Although these types of working machines also are turned around indifferent directions in use, each of them has a weight greater than one having a displacement of 40 cc or less, and therefore is not very often shaken violently in use. However, if the type of the engine as disclosed in JP2004-251231 is used in a working machine, problems occur in the blowby gas separation, and therefore oil is consumed quickly. Meanwhile, if the type of the engine as disclosed in JP2011-069240, the performance of lubricating the valve operating members degrades, so that the valve operating members may be damaged quickly.

SUMMARY

It is therefore an object of the present invention to provide a four-stroke engine configured to improve the lubrication performance and being able to be mounted in a portable working machine or a backpack working machine that can be turned around in different directions in use.

According to a first aspect of the present invention, a four-stroke engine configured to lubricate driving parts including a crankshaft and valve operating members while circulating oil, using pressure fluctuation in a crank chamber, the pressure fluctuation being caused by reciprocating motion of a piston includes: an intake valve and an exhaust valve configured to open and close a combustion chamber; a rocker chamber configured to accommodate the intake valve and the exhaust valve; a cam to drive the intake valve and the exhaust valve; cam driving parts to drive the cam; a driving chamber configured to accommodate the cam driving parts; a tank to accumulate oil therein; and a gas-liquid separator configured to separate blowby gas from oil used for lubrication. The cam driving parts move with rotation of the crankshaft; the driving chamber and the rocker chamber are connected to one another; the rocker chamber is connected to the crank chamber and the gas-liquid separator; the oil accumulated in the tank is sucked up into the crank chamber and circulated through each part of the four-stroke engine; the crank chamber and the driving chamber are connected to one another via a communicating passage and a return passage; and the crank chamber and the driving chamber connected to one another via the return passage communicate with one another only when the piston is located in a vicinity of a top dead center.

Preferably, the communicating passage is connected to a lower part of the crank chamber.

Preferably, the rocker chamber and the crank camber are connected to one another via a direct passage; and the rocker chamber and the crank chamber connected to one another via the direct passage communicate with one another only when the piston is located in a vicinity of a top dead center.

Preferably, the gas-liquid separator is connected to the crank chamber via a reflux passage; and the gas-liquid separator and the crank chamber connected to one another via the reflux passage communicate with one another only when the piston is located in a vicinity of a top dead center, and oil separated in the gas-liquid separator is supplied to the crank chamber.

Preferably, the tank communicates with a lower part of the driving chamber.

Preferably, the cam is provided in the driving chamber.

Preferably, the cam driving parts are formed by a pair of gear parts made of synthetic resin, a first gear part being directly connected to the crankshaft, and a second gear part being formed integrally with the cam.

Preferably, the communicating passage is open in the driving chamber in the vicinity of an engagement portion of the gear parts.

Preferably, cam followers contact an outer periphery of the cam; push rods contact the cam followers; the intake valve and the exhaust valve are driven by converting rotational motion of the cam into reciprocating motion of the push rods; the second gear part has a larger gear wheel than the cam; and the communicating passage is open in the driving chamber in a vicinity of an outer periphery of the cam.

Preferably, the oil is sucked up from the tank into the crank chamber via an oil supply passage; oil remaining in the rocker chamber is supplied from the rocker chamber to the crank chamber via a direct passage; oil separated in the gas-liquid separator is supplied to the crank chamber via a reflux passage; the tank and the crank chamber connected to one another via the oil supply passage communicate with one another only when the piston is located in a vicinity of a top dead center; the rocker chamber and the crank chamber connected to one another via the direct passage communicate with one another only when the piston is located in the vicinity of the top dead center; the gas-liquid separator and the crank chamber connected to one another via the reflux passage communicate with one another only when the piston is located in the vicinity of the top dead center; and the crank chamber and the driving chamber connected to one another via the communicating passage communicate with one another when the piston moves to a bottom dead center while the oil supply passage, the direct passage and the reflux passage are closed by the piston.

Preferably, the crank chamber and the driving chamber connected to one another via the communicating passage communicate with one another when the piston moves to the bottom dead center just after a combustion chamber ignites.

Preferably, a through-hole is formed in the second gear; the through-hole overlaps the communicating passage, so that the communicating passage and the driving chamber communicate with one another.

Preferably, the communicating passage overlaps the through-hole in a position in which the communicating passage is enclosed by the cam and the cam followers thereby to communicate with the driving chamber.

According to a second aspect of the present invention, a four-stroke engine configured to lubricate driving parts including a crankshaft and valve operating members while circulating oil, using pressure fluctuation in a crank chamber, the pressure fluctuation being caused by reciprocating motion of a piston includes: an intake valve and an exhaust valve configured to open and close a combustion chamber; a rocker chamber configured to accommodate the intake valve and the exhaust valve; a cam to drive the intake valve and the exhaust valve; and a driving chamber configured to accommodate the cam. The driving chamber and the rocker chamber are connected to one another; the crank chamber and the driving chamber are connected to one another via a communicating passage and a return passage; the crank chamber and the driving chamber connected to one another via the return passage communicate with one another only when the piston is located in a vicinity of a top dead center; and an oil circulating route is formed to circulate the oil between the crank chamber and the driving chamber.

Preferably, the rocker chamber and the crank camber are connected to one another via a direct passage; and the rocker chamber and the crank chamber connected to one another via the direct passage communicate with one another only when the piston is located in the vicinity of the top dead center.

According to a third aspect of the present invention, a four-stroke engine configured to lubricate driving parts including a crankshaft and valve operating members while circulating oil, using pressure fluctuation in a crank chamber, the pressure fluctuation being caused by reciprocating motion of a piston and includes: an intake valve and an exhaust valve configured to open and close a combustion chamber; a rocker chamber configured to accommodate the intake valve and the exhaust valve; a cam to drive the intake valve and the exhaust valve; and a driving chamber configured to accommodate the cam. The driving chamber and the rocker chamber are connected to one another; the crank chamber and the driving chamber are connected to one another via a communicating passage and a return passage; a pressure in the crank chamber varies between a upper limit and a lower limit while the piston reciprocates once; the oil is supplied under pressure from the crank chamber to the driving chamber via the communicating passage in a process in which the pressure in the crank chamber varies from the lower limit to the upper limit; and the driving chamber and the crank chamber connected to communicate with one another when the pressure in the crank chamber is approximately the lower limit.

Preferably, the rocker chamber and the crank camber are connected to one another via a direct passage; and the rocker chamber and the crank chamber connected to one another via the direct passage communicate with one another when the pressure in the crank chamber is approximately the lower limit.

With the present invention, it is possible to provide a four-stroke engine configured to improve the lubrication performance and being able to be mounted in a portable working machine or a backpack working machine that can be turned around in different directions in use.

DESCRIPTION OF EXEMPLARY EMBODIMENTS

Embodiment 1

Figure 1:
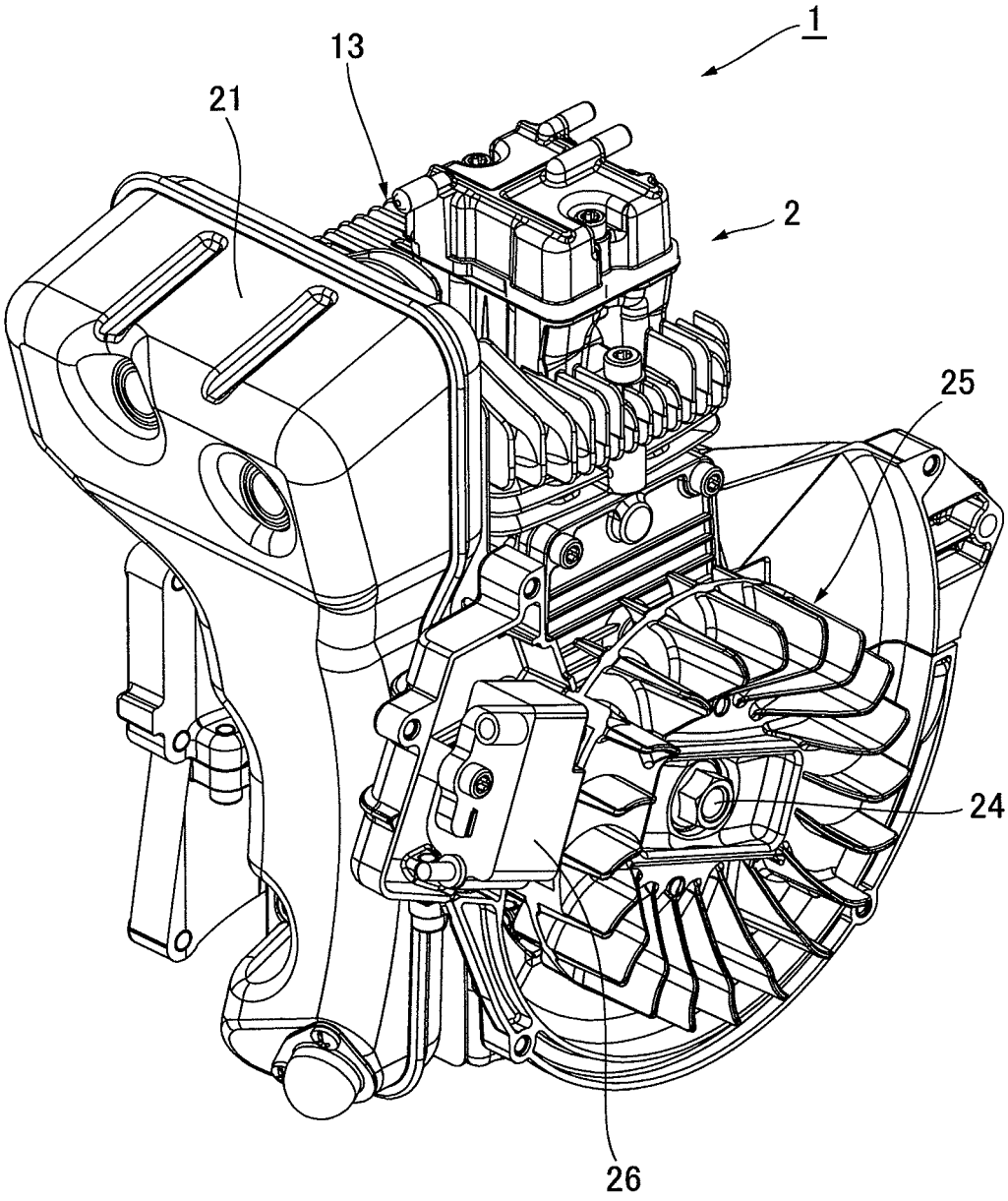
FIG. 1 is a perspective view showing a four-stroke engine according to Embodiment 1 of the present invention.
Figure 2:
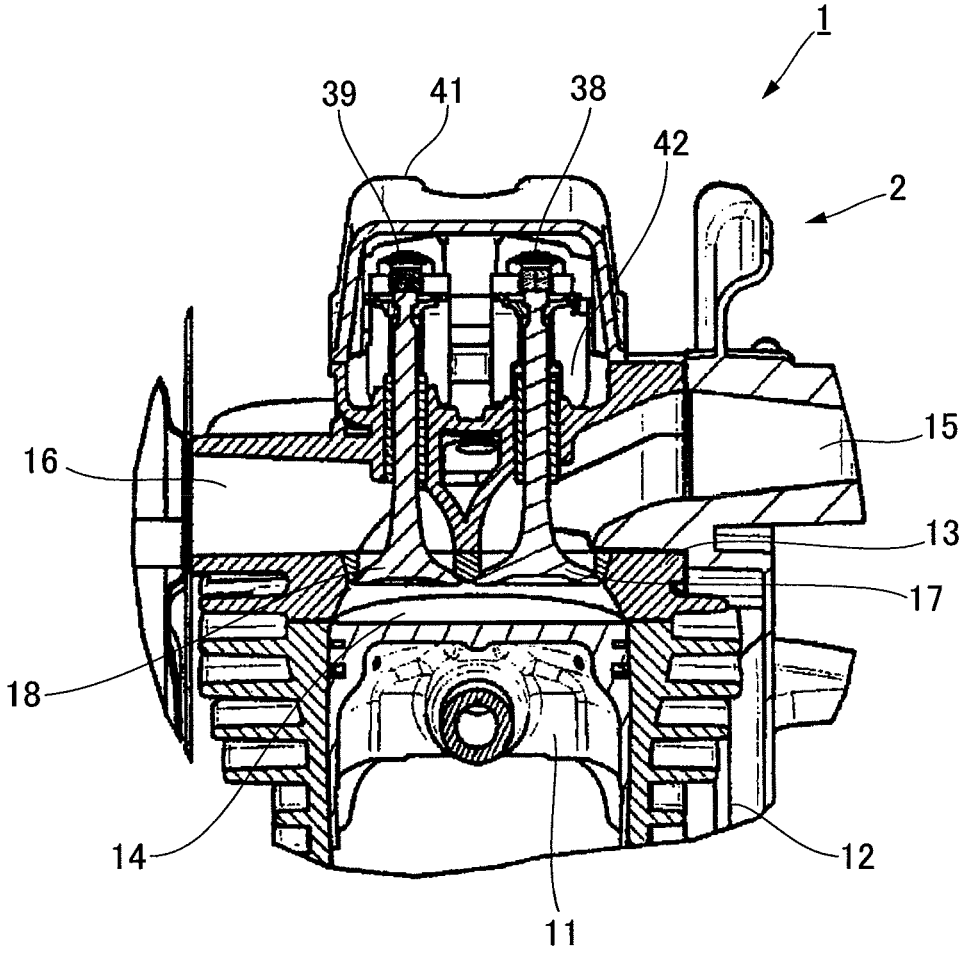
FIG. 2 is a first partial cross-sectional view showing the four-stroke engine according to Embodiment 1 of the present invention.
Figure 3:
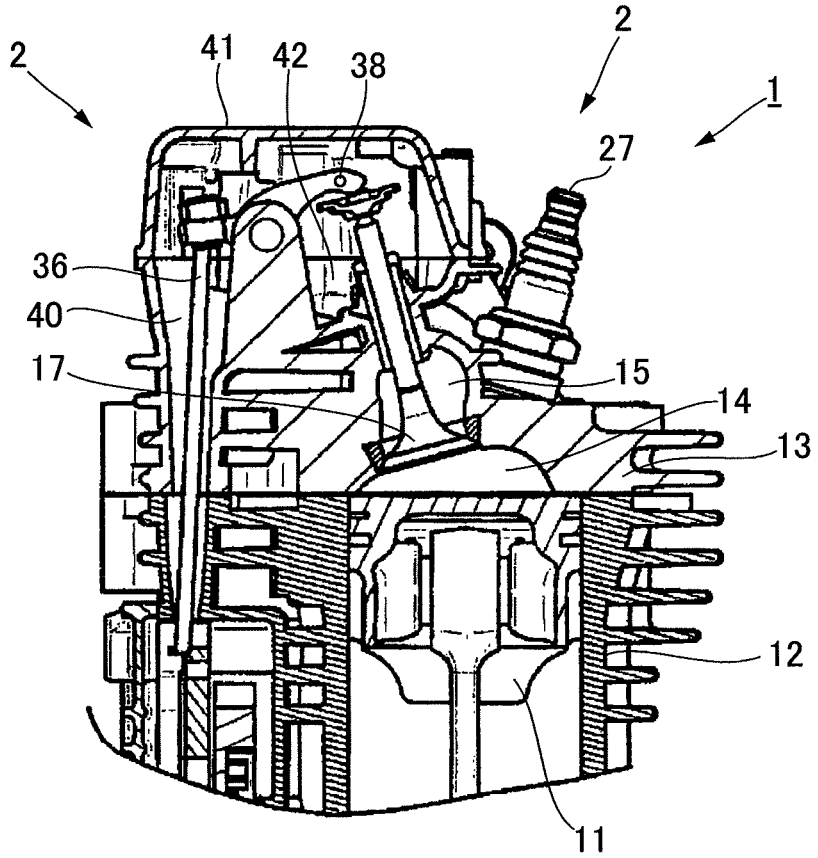
FIG. 3 is a second partial cross-sectional view showing the four-stroke engine according to Embodiment 1 of the present invention.
Figure 11:
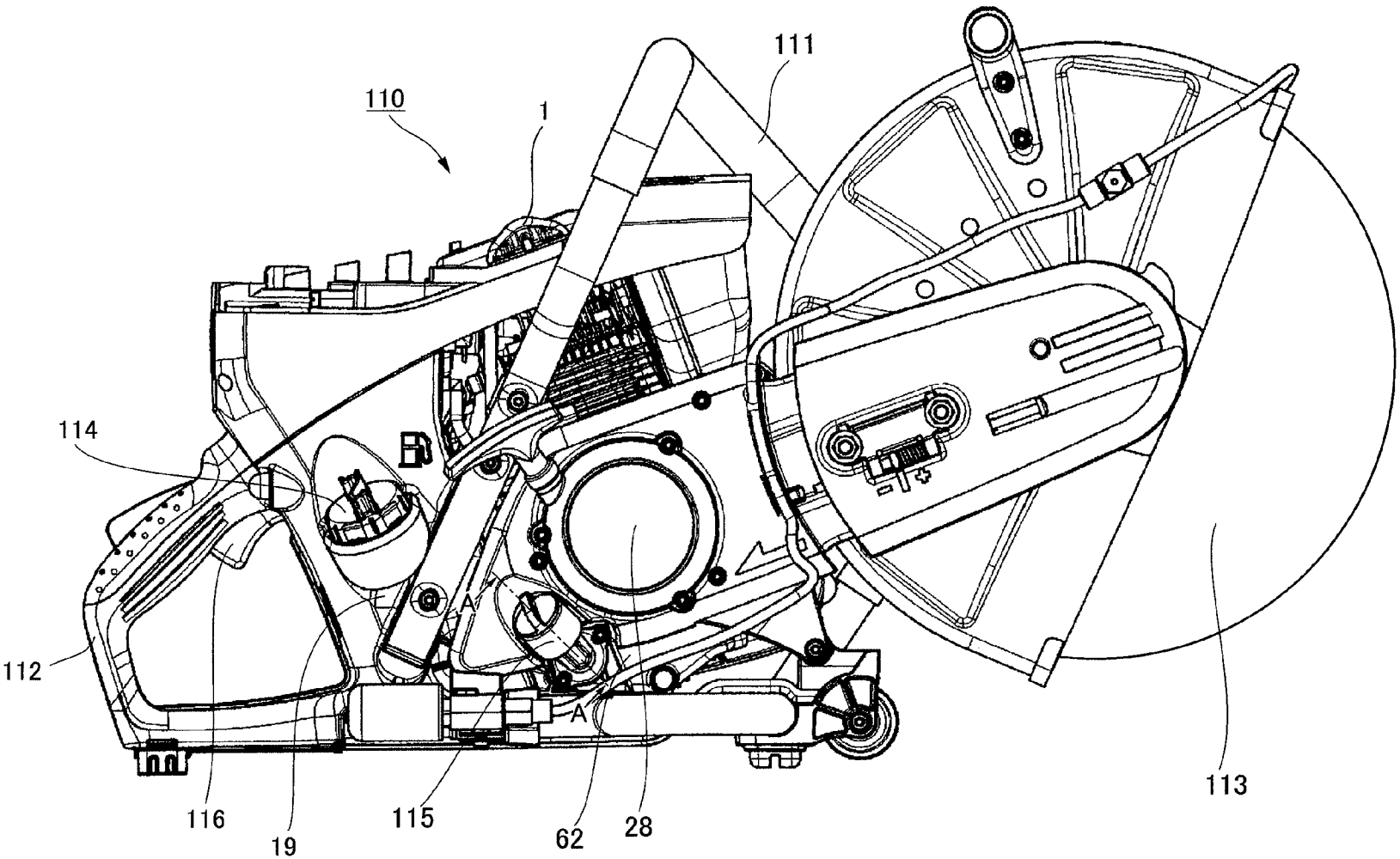
FIG. 11 is a side view showing a concrete cutter that is an exemplary portable working machine equipped with the four-stroke engine according to the embodiments of the present invention.
Figure 12:
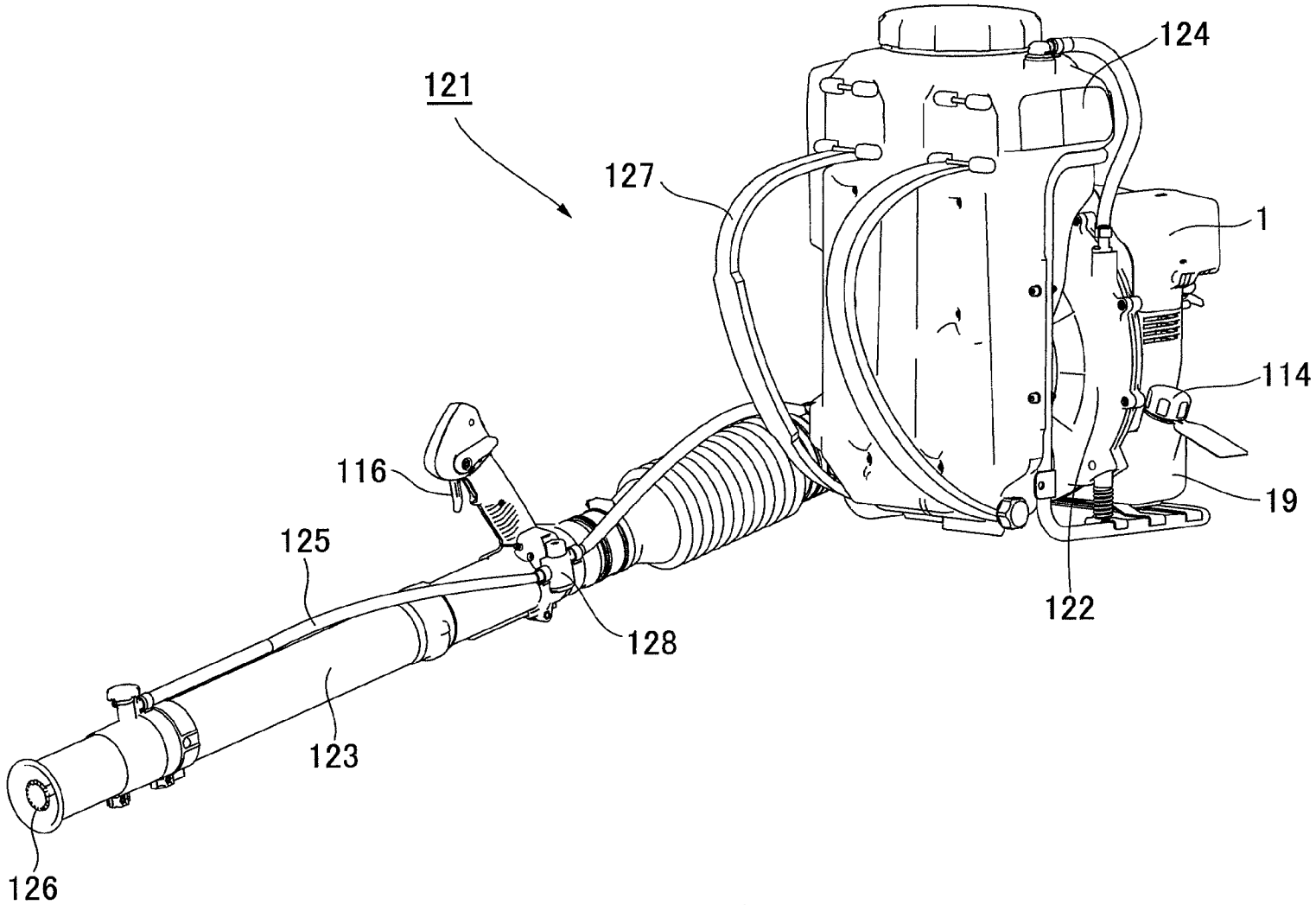
FIG. 12 is a perspective view showing a mist blower that is an exemplary backpack working machine equipped with the four-stroke engine according to the embodiments of the present invention.

FIG. 1 shows a main body 2 of a four-stroke engine 1 according to Embodiment 1 of the present invention. FIG. 2 and FIG. 3 each shows a partial structural drawing explaining the drive principle of the four-stroke engine 1 according to Embodiment 1 of the present invention. FIG. 11 shows a concrete cutter 110 that is an exemplary working machine equipped with the four-stroke engine 1 according to Embodiment 1 of the present invention. FIG. 12 shows a mist blower 121 that is an exemplary backpack working machine equipped with the four-stroke engine 1 according to Embodiment 1 of the present invention.

[The Drive Structure of the Engine]

Figure 5:
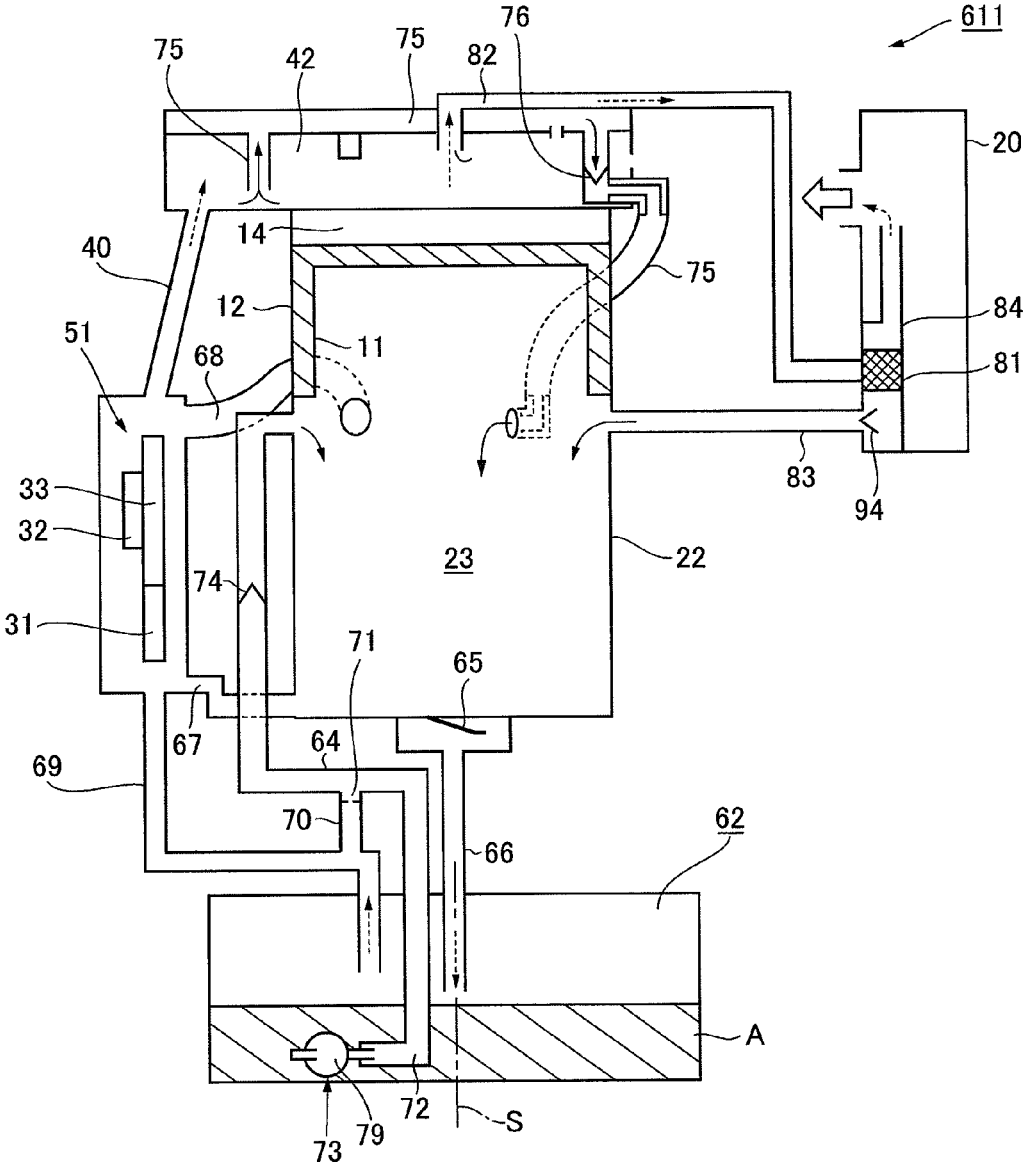
FIG. 5 is a schematic view showing a lubrication apparatus according to Embodiment 1 of the present invention.

The four-stroke engine 1 according to Embodiment 1 includes a cylinder 12 that accommodates a piston 11 to be able to slide therein as shown in FIG. 2, FIG. 3 and FIG. 5. A cylinder head 13 is mounted on the cylinder 12. Then, a combustion chamber 14 is defined by the piston 11, the cylinder 12 and the cylinder head 13. An intake passage 15 and an exhaust passage 16 are connected to the combustion chamber 14. When an intake valve 17 and an exhaust valve 18 open and close, the intake passage 15 and the exhaust passage 16 communicate and do not communicate with the combustion chamber 14, respectively. A carburetor (not shown) is connected to the intake passage 15. This carburetor is connected to a fuel tank 19 via a fuel passage (not shown). The intake passage 15 is also connected to an air cleaner 20 via the carburetor. A muffler 21 is connected to the exhaust passage 16.

A crankcase 22 is mounted under the cylinder 12. Then, the crank chamber 23 is defined by the piston 11, the cylinder 12 and the crankcase 22. A crankshaft 24 is provided in the crank chamber 23 to be rotated in the crank chamber 23. A connecting rod (not shown) connects between the piston 11 and the crankshaft 24. The reciprocating motion of the piston 11 is converted into the rotational motion of the crankshaft 24. As the piston 11 reciprocates, the volume of the combustion chamber 14 and the crank chamber 23 varies.

As shown in FIG. 1, a flywheel 25 is mounted to the crankshaft 24 and functions as an air-cooling fan and an electric generator. As shown in FIG. 1, an ignition circuit 26 is provided in the vicinity of the flywheel 25 and electrically connected to a plug 27. As shown in FIG. 3, the plug 27 is provided in the cylinder head 13, and an ignition part of the plug 27 protrudes into the combustion chamber 14. A recoil starter 28 (see FIG. 11) as a starting device is also mounted to the crankshaft 24.

When the recoil starter 28 is used while the four-stroke engine 1 stops, the crankshaft 24 rotates, and therefore the piston 11 reciprocates according to the rotation of the crankshaft 24. The reciprocating motion of the piston 11 causes a change in the volume of the combustion chamber 14. Then, the intake valve 17 opens at a predetermined time during which the pressure in the combustion chamber 14 reduces. This allows communication between the combustion chamber 14 and the air cleaner 20 via the intake passage 15.

The combustion chamber 14 communicating with the air cleaner 20 sucks the air while receiving fuel from the carburetor, and therefore is filled with air-fuel mixture. Then, at the time the combustion chamber 14 is fully filled with the air-fuel mixture, the intake valve 17 is closed. The piston 11 having passed through the bottom dead center moves to the top dead center while the intake valve 17 and the exhaust valve 18 are closed. Therefore, the pressure in the combustion chamber 14 filled with the air-fuel mixture increases. At the time the piston 11 reaches the vicinity of the top dead center while the combustion chamber 14 is filled with air-fuel mixture, the ignition circuit 26 is activated, and the ignition circuit 26 and the plug 27 become electrically conductive. The ignition circuit 26 and plug 27 being electrically conductive cause electric discharge from the ignition part of the plug 27. The spark of the electrical discharge ignites the air-fuel mixture in the combustion chamber 14. The air-fuel mixture just after the ignition tends to greatly expand due to the chemical reaction and the heat generated by the combustion. Therefore, the force is applied to the piston 11 to be pushed down strongly to the bottom dead center. After moving to the bottom dead center by the combustion of the fuel mixture and then passing through the bottom dead center, the piston 11 moves to the top dead center. At this time, the exhaust valve 18 opens, and therefore the combustion chamber 14 communicates with the muffler 21 via the exhaust passage 16. The combustion chamber 14 communicating with the muffler 21 discharges combustion gas to the outside via the muffler 21 because of a decrease in the volume of the combustion chamber 14. Then, at the time the combustion gas is discharged from the combustion chamber 14, the exhaust valve 18 is closed.

In this way, the four-stroke engine 1 is started by using the recoil starter 28. Then, after being started, the four-stroke engine 1 continues to drive, generating a greater output than the output required for starting. The output of the four-stroke engine 1 is controlled by a throttle lever 116 (see FIG. 11 and FIG. 12). The supply of air-fuel mixture is controlled depending on the amount of the operation of the throttle lever 116. The main body 2 of the four-stroke engine 1 heated while the four-stroke engine 1 is driven, is cooled by the air flow generated by the rotation of the flywheel 25. In order to stop driving the four-stroke engine 1, a stop switch (not shown) is used. By using the stop switch, the generated electricity is not supplied to the plug 27, so that the plug 27 does not ignite. Consequently, the four-stroke engine 1 is stopped.

[The Drive Structure of Valve Operating Members]

Figure 4:
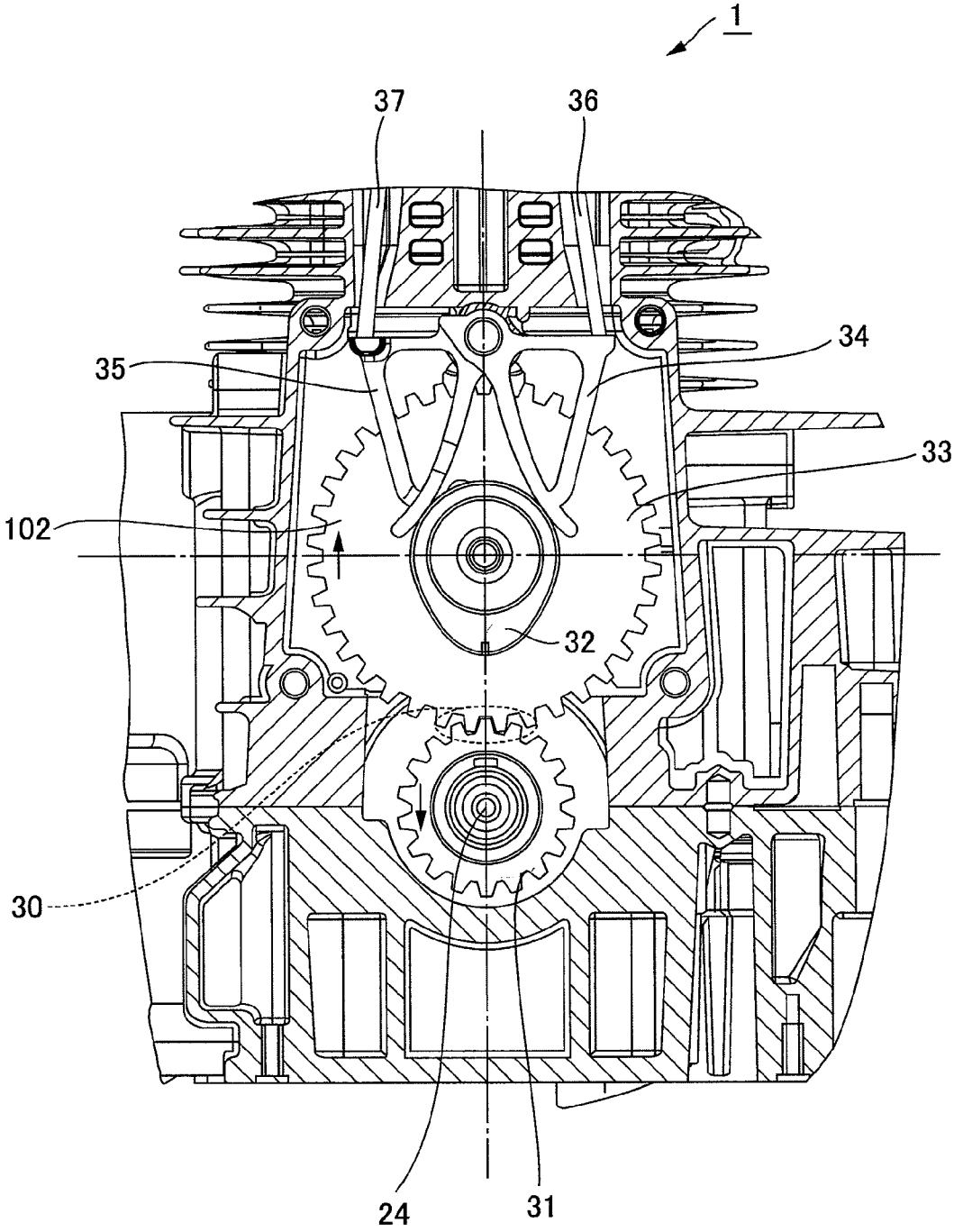
FIG. 4 is a third partial cross-sectional view showing the four-stroke engine according to Embodiment 1 of the present invention.

Next, the structure of valve operating members according to Embodiment 1 of the present invention will be explained. As shown in FIG. 4, a drive gear (one gear part) 31 is connected to the crankshaft 24. Then, a cam gear (the other gear part) 33 formed integrally with a cam 32 engages with the drive gear 31 to move with the drive gear 31. The gear ratio between the drive gear 31 and the cam gear 33 is controlled such that the cam gear 33 is rotates once while the drive gear 31 rotates twice. That is, a gear wheel 102 of the cam gear 33 is greater than the drive gear 31. In order to form the larger gear wheel 102 of the cam gear 33, the gear wheel 102 of the cam gear 33 is greater than the cam 32. A first cam follower 34 and a second cam follower 35 contact the outer periphery of the cam 32, and swing with the rotation of the cam 32. A first push rod 36 and a second push rod 37 are connected to the first cam follower 34 and the second cam follower 35, respectively. As shown in FIGS. 2 and 3, a first rocker arm 38 and a second rocker arm 39 are connected to the first push rod 36 and the second push rod 37, respectively. Then, the first rocker arm 38 is connected to the intake valve 17 and the second rocker arm 39 is connected to the exhaust valve 18.

The crankshaft 24 and the drive gear 31 rotate together, and this rotation is transmitted to the cam 32 as rotational motion. The rotational motion of the cam 32 is converted into the swing motion of the first cam follower 34 and the second cam follower 35. The swing motion of the first cam follower 34 is transmitted to the first push rod 36, the first rocker arm 38 and the intake valve 17 in this order to open and close the intake valve 17. The swing motion of the second cam follower 35 is transmitted to the second push rod 37, the second rocker arm 39 and the exhaust valve 18 in this order to open and close the exhaust valve 18. The intake valve 17 and the exhaust valve 18 opens once while the crankshaft 24 rotates twice, but is closed most of the time except for that time. Then, the first cam follower 34 and the second cam follower 35 swing in the same period, and properly open and close the combustion chamber 14 by appropriately shifting the phase of the swinging motion between the first cam follower 34 and the second cam follower 35. As shown in FIG. 4, while the peak of the cam 32 is located at the bottom, the combustion chamber 14 is filled with air-fuel mixture and the piston 11 is located at the top dead center.

Part of the cylinder head 13 serves as a partition between the inside and the outside of the combustion chamber 14. A rocker chamber 42 is formed by covering the outside part with a rocker cover 41. The first rocker arm 38 and the second rocker arm 39 are provided in the rocker chamber 42. The intake valve 17 and the exhaust valve 18 are formed to penetrate the cylinder head 13. The intake passage 15 and the exhaust passage 16 are formed in the inside of the partition of the cylinder head 13 and communicate with the combustion chamber 14. The intake valve 17 and the exhaust valve 18 open and close the openings of the intake passage 15 and the exhaust passage 18 into the combustion chamber 14.

The first push rod 36 and the second push rod 37 are accommodated in a push rod guide 40. Then, the push rod guide 40 is connected to the rocker chamber 42.

As described above, the drive gear 31 is connected to the crankshaft 24 and mounted to the main body 2 of the four-stroke engine 1 from the outside. The cam gear 33 is rotatably fixed in the cylinder head 13 side to engage with the drive gear 31. The first cam follower 34 and the second cam follower 35 are swingably fixed in the cylinder head 13 side to contact the cam 32. A driving chamber 51 is formed like a cover that covers the engine body 2 of the four-stroke engine 1 from the outside. The drive gear 31, the cam gear 33, the first cam follower 34 and the second cam follower 35 are accommodated in the driving chamber 51. Then, the driving chamber 51 is connected to the push rod guide 40.

With Embodiment 1, the drive gear 31, the first cam follower 34, the second cam follower 35, the first push rod 36, the second push rod 37, the first rocker arm 38, the second rocker arm 39, the intake valve 17 and the exhaust valve 18 are made of iron metal. As for the cam gear 33, the cam 32 is made of iron metal, while the gear wheel 102 is made of synthetic resin. The cam gear 33 is obtained by casting the finished cam 32 with the synthetic resin gear wheel 102 in one piece.

By forming the valve operating members with synthetic resin, it is possible to reduce the main body 2 of the four-stroke engine 1 in weight. For example, the drive gear 31, the cam gear 33, the first cam follower 34, the second cam follower 35, the first push rod 36 and the second push rod 37 may be made of synthetic resin. In this case, metal is attached to the ends of the push rods 36 and 37 in the side of the rocker arms 38 and 39, so that it is possible to protect push rods 36 and 37 from the friction against the metal rocker arms 38 and 39. Here, only by using synthetic resin to form the valve operating members, the valve operating members may be damaged due to the friction in a shorter time than expected. However, by improving the lubrication performance using a lubrication apparatus 611 described later, it is possible to prevent damage due to friction.

[The Structure of the Lubrication Apparatus 611 According to Embodiment 1 of the Present Invention]

Next, the structure of the lubrication apparatus 611 of Embodiment 1 of the present invention will be explained. FIG. 5 is a schematic view showing the lubrication apparatus 611 according to Embodiment 1.

Figure 6:
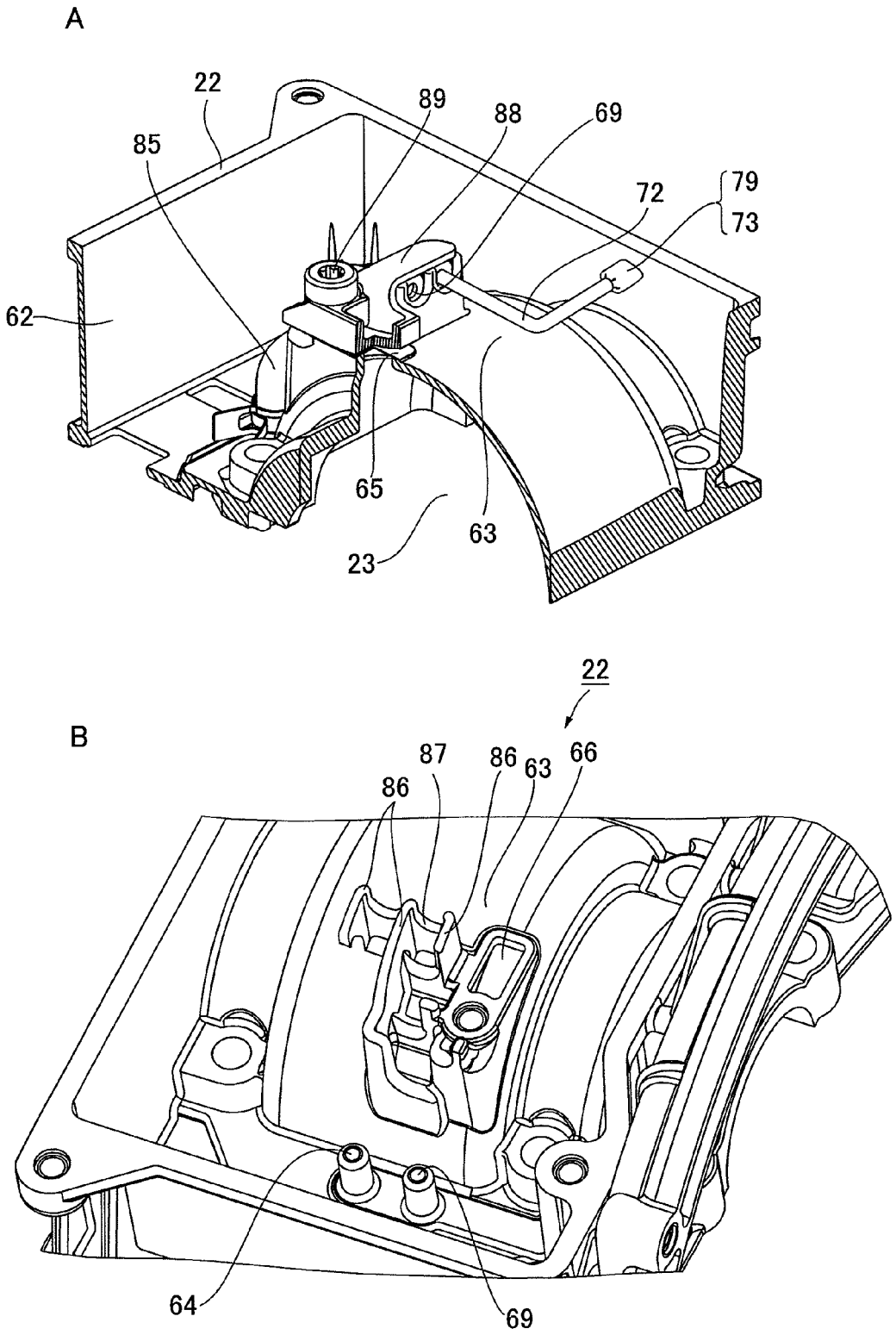
FIGS. 6A and 6B are partial exploded perspective views each showing the internal structure of an oil tank according to Embodiment 1 of the present invention.

An oil tank 62 is formed by attaching a cover to the bottom of the crankcase 22. As shown in FIG. 6, the crankcase 22 is divided into the crank chamber 23 and the oil tank 62 by a partition wall 63. Oil for lubricating the driving parts such as the crankshaft 24 and the valve operating members is accumulated in the oil tank 62.

The oil tank 62 and the crank chamber 23 are connected to one another via an oil supply passage 64. The crank chamber 23 and the oil tank 62 are connected to one another via a reed valve 65 and a first discharge passage 66. The crank chamber 23 and the driving chamber 51 are connected to one another via a communicating passage 67. The driving chamber 51 and the crank chamber 23 are connected to one another via a return passage 68. The driving chamber 51 and the oil tank 62 are connected to one another via a second oil discharge passage 69. The oil supply passage 64 and the second oil discharge passage 69 are connected to one another via a flow rate control passage 70 having a flow restrictor 71.

The oil supply passage 64 is connected to a flexible tube 72 in the oil tank 62. A weight 79 is mounted on the vicinity of one end of the flexible tube 72. The one end of the flexible tube 72 functions as an oil supply hole 73. Even if the main body 2 of the four-stroke engine 1 is in any posture, the weight 79 allows the oil supply hole 73 of the oil supply passage 64 to be below the level of the oil. The pressure in the crank chamber 23 is changed by the reciprocating motion of the piston 11. The pressure in the crank chamber 23 increases and changes from a negative pressure to a positive pressure, as the piston 11 moves from the top dead center to the bottom dead center. The pressure in the crank chamber 23 decreases and changes from a positive pressure to a negative pressure, as the piston 11 moves from the bottom dead center to the top dead center. While the piston 11 reciprocates once, the pressure in the crank chamber 23 changes from the upper limit to the lower limit. The pressure in the crank chamber 23 is the lower limit when the piston 11 is located in the vicinity of the top dead center. On the other hand, the pressure in the crank chamber 23 is the upper limit when the piston 11 is located in the vicinity of the bottom dead center. Here, the upper limit value and the lower limit value of the pressure in the crank chamber 23 may vary depending on, for example, the rate of rotation of the four-stroke engine 1. The oil supply passage 64 and the crank chamber 23 are connected to communicate with one another only when the piston 11 is located in the vicinity of the top dead center. At other times, the oil supply passage 64 is closed by the piston 11. In addition, a one-way valve 74 that allows oil to flow in only one direction from the oil tank 62 to the crank chamber 23 is provided in the oil supply passage 64. With this configuration, even if the main body 2 of the four-stroke engine 1 is in any posture, it is possible to supply a sufficient amount of oil from the oil tank 62 to the crank chamber 23, using the negative pressure in the crank chamber 23, and therefore lubricate the crankshaft 24 and the piston 11 sufficiently. In addition, by connecting the flow rate control passage 70 to the oil supply passage 64, air is mixed into the oil supplied to the crank chamber 23, and therefore the amount of oil supplied is reduced. Then, the amount of oil supplied can be adequately controlled by the flow restrictor 71 provided in the flow rate control passage 70. With the flow rate control passage 70 and the flow restrictor 71, it is possible to prevent the oil from being oversupplied from the oil tank 62 to the crank chamber 23, and therefore control the flow of oil adequately.

The communication passage 67 is connected to the lower part of the crank chamber 23. Then, the outlet of the first oil discharge passage 66 is formed in the partition wall 63 of the crankcase 22. The reed valve 65 is mounted in this outlet to connect the first oil discharge passage 66 to the oil tank 62. The second oil discharge passage 69 is connected to the vicinity of the bottom of the driving chamber 51. With this configuration, it is possible to supply oil and oil mist having a high density under pressure from the vicinity of the lower part of the crank chamber 23 to the driving camber 51 through the communicating passage 67, using a positive pressure created in the process in which the pressure in the crank chamber 23 changes from the lower limit to the upper limit. Therefore, it is possible to sufficiently lubricate the valve operating members accommodated in the valve operating chamber 51 and form the valve operating members with synthetic resin. In addition, it is possible to collect the excess oil remaining in the crank chamber 23 into the oil tank 62 via the first oil discharge passage 66. Meanwhile, it is possible to collect the excess oil remaining in the driving chamber 51 into the oil tank 62 via the second oil discharge passage 69. Here, when oil is short in the driving chamber 51, oil mist is supplied from the oil tank 62 to the driving chamber 51 via the second oil discharge passage 69, so that it is possible to lubricate the valve operating members. With the present embodiment, although there is no one-way valve in the communicating passage 67, a one-way valve may be provided in the communicating passage 67 to allow oil to flow in only one direction from the crank chamber 23 to the valve operating chamber 51.

The return passage 68 is connected to the crank chamber 23 to communicate with the crank chamber 23 only when the piston 11 is located in the vicinity of the top dead center. At other times, the return passage 68 is closed by the piston 11. With this configuration, it is possible to suck a sufficient amount of oil from the driving chamber 51 into the crank chamber 23, using the negative pressure in the crank chamber 23 at approximately the lower limit. Therefore, oil is not oversupplied to the rocker chamber 42 connected to the driving chamber 51 via the push rod guide 40. The return passage 68 is connected to the upper part of the driving chamber 51. This ensures that the valve operating members accommodated in the driving chamber 51 are lubricated sufficiently. In this way, oil flows through the crank chamber 23, the communicating passage 67, the driving chamber 51, the return passage 68 and the crank chamber 23 in this order to form one oil circulating route.

The rocker chamber 42 and the crank chamber 23 are connected to one another via a direct passage 75. The direct passage 75 is connected to the crank chamber 23 to communicate with the crank chamber 23 only when the piston 11 is located in the vicinity of the top dead center. At other times, the direct passage 75 is closed by the piston 11. In addition, a one-way valve 76 is provided in the direct passage 75 to allow oil to flow in only one direction from the rocker chamber 42 to the crank chamber 23. The direct passage 75 has a plurality of suction openings in the upper part and the lower part of the rocker chamber 42. With this configuration, even if the main body 2 of the four-stroke engine 1 is in any posture, it is possible to suck a sufficient amount of oil from the rocker chamber 42 into the crank chamber 23, using the negative pressure in the crank chamber 23 at approximately the lower limit. Therefore, it is possible to prevent the excess oil from remaining in the rocker chamber 42.

A gas-liquid separator 81 is provided in the air cleaner 20. This gas-liquid separator 81 is connected to the rocker chamber 42 via a blowby gas feeding passage 82. The gas-liquid separator 81 is connected to the crank chamber 23 via a reflux passage 83, and therefore the oil separated from blowby gas in the gas-liquid separator 81 is supplied to crank chamber 23. The gas-liquid separator 81 is connected to the intake passage 15 via a blowby gas discharge passage 84. The blowby gas separated in the gas-liquid separator 81 is fed to the combustion chamber 14.

The blowby gas feeding passage 82 is provided to open in the vicinity of the center of the rocker chamber 42. The blowby gas containing oil mist is fed to the gas-liquid separator 81 formed by wire mesh and so forth through the blowby gas feeding passageway 82, and the wire mesh catches oil mist in the gas-liquid separator 81 to separate oil from blowby gas. By providing the opening of the blowby gas feeding passage 82 in the vicinity of the center of the rocker chamber 42, even if the main body 2 of the four-stroke engine 1 is in any posture, it is possible to prevent the oil remaining in the rocker chamber 42 from being supplied to the gas-liquid separator 81.

The reflux passage 83 is connected to the crank chamber 23 to communicate with the crank chamber 23 only when the piston 11 is located in the vicinity of the top dead center. At other times, the reflux passage 83 is closed by the piston 11. In addition, a one-way valve 94 is provided in the reflux passage 83 to allow oil to flow in only one direction from the gas-liquid separator 81 to the crank chamber 23. With this configuration, it is possible to suck a sufficient amount of oil from the gas-liquid separator 81 into the crank chamber 23, using the negative pressure in the crank chamber 23. Also it is possible to prevent oil from being discharged from the gas-liquid separator 81 to the blowby gas discharge passage 84, and therefore prevent oil from being consumed quickly.

Here, when the piston moves to the bottom dead center while the oil supply passage 64, the direct passage 75, the reflux passage 83, and the return passage 68 are closed by the piston 11, the oil is forcefully pushed out of the crank chamber 23 to the driving chamber 51.

Here, another configuration is possible where first, the oil supply passage 64, the direct passage 75 and the reflux passage 83 are closed by the piston 11, and after that, the return passage 68 is closed. With this configuration, air is adequately delivered from the crank chamber 23 to the valve operating chamber 51, and after that, the oil is forcefully pushed out via the communicating passage 67. Therefore, it is possible to adequately control the amount of oil to be supplied to the driving chamber 51.

FIGS. 6A and 6B show the layout of the inside of the oil tank 62 in which the oil supply passage 64, the first oil discharge passage 66 and the second oil discharge passage 69 are arranged. FIG. 6A shows a state in which flexible tubes 72 and 85 and so forth are fixed by fixing part 88. FIG. 6 shows the inside of the oil tank 62 where the fixing member 88 is removed, so that only the crankcase 22 is shown. The oil supply passage 64 is formed such that the flexible tube 72 is easily attached to the oil supply passage 64. As shown in FIG. 6B, the oil supply passage 64 protrudes from the crankcase 22 like a pipe. Then, the flexible tube 72 is attached to the pipe-like part of the oil supply passage 64. Likewise, the second oil discharge passage 69 also protrudes from the crankcase 22 like a pipe. Then, the flexible tube 85 is attached to the pipe-like part of the second oil discharge passage 69. An upright wall 86, a coupling wall 87 and the outlet of the first oil discharge passage 66 are formed to be close to each other on the partition wall 63 of the crankcase 22. The upright wall 86 and the coupling wall 87 are formed to hold the flexible tube 72 and the flexible tube 85. As shown in FIG. 6A, the reed valve 65, the flexible tube 72 and the flexible tube 85 are fixed by the fixing part 88. The reed valve 65 is mounted in the outlet of the first oil discharge passage 66. One end of the reed valve 65 is fixed to the fixing part 88 to be able to swing. The fixing part 88 is fixed by a bolt 89. The flexible tube 72 and the flexible tube 85 are fixedly sandwiched between the upright wall 86 and the coupling wall 87. The flexible tube 85 is fixed not to protrude from the upright wall 86. One end of the flexible tube 85 is the outlet of the second oil discharge passage 69. The flexible tube 72 protrudes from the upright wall 86 and is fixed. Here, the reed valve 65, the flexible tube 72 and the flexible tube 85 are fixed in the vicinity of the center of the oil tank 62. The outlet of the first oil discharge passage 66 is located in the vicinity of the center of the oil tank 62. Therefore, even if the main body 2 of the four-stroke engine 1 is in any posture, it is possible to place the outlet of the first oil discharge passage 66 above the level of the oil accumulated in the oil tank 62. The outlet of the first oil discharge passage 66 is located above the level of the oil, so that it is possible to prevent oil from flowing back to the crank chamber 23. In addition, the outlet of the second oil discharge passage 69 is located in the vicinity of the center of the oil tank 62. By this means, even if the main body 2 of the four-stroke engine 1 is in any posture, it is possible to place the outlet of the second oil discharge passage 69 above the level of the oil accumulated in the oil tank 62. The outlet of the second oil discharge passage 69 is located above the level of the oil, and therefore it is possible to prevent the oil from flowing from the oil tank 62 into the driving chamber 51. The flexible tube 72 is fixed to the vicinity of the center of the oil tank 62, and therefore can freely move around a point in the vicinity of the center of the oil tank 62. Consequently, even if the main body 2 of the four-stroke engine 1 is in any posture, the flexible tube 72 with the weight 79 can freely move and a fuel filler opening 73 is located below the level of the oil.

In this way, the four-stroke engine 1 according to Embodiment 1 can supply a sufficient amount of oil to the driving chamber 51, and therefore improve the performance of lubricating the valve operating members accommodated in the driving chamber 51. It is possible to form the valve operating members with synthetic resin because of improving the performance of lubricating the valve operating members accommodated in the driving chamber 51. Consequently, it is possible to reduce the main body 2 of the four-stroke engine 1 in weight. In addition, it is possible to prevent oil from being oversupplied to the rocker chamber 42 and also prevent excess oil from remaining in the rocker chamber 42. This prevents oil from being oversupplied to the gas-liquid separator 81, and therefore it is possible to improve the performance of separating oil from blowby gas. Then, the separated oil can be efficiently supplied to the crankcase 22. Therefore, it is possible to prevent oil from being discharged to the combustion chamber 14 and also prevent oil from being consumed quickly.

Embodiment 2

[The Structure of a Lubrication Apparatus 612 According to Embodiment 2 of the Present Invention]

Figure 7:
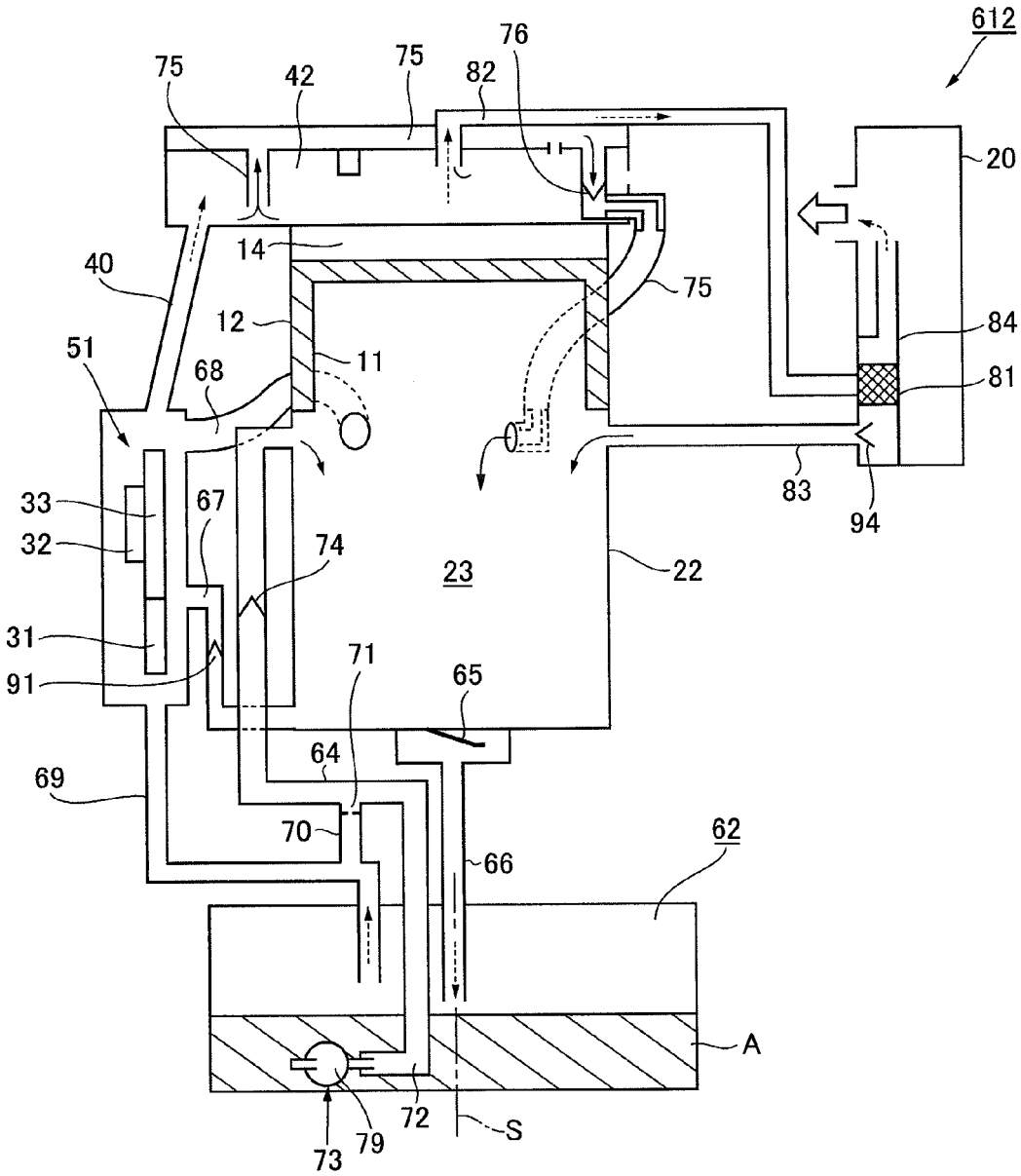
FIG. 7 is a schematic view showing a lubrication apparatus according to Embodiment 2 of the present invention.

FIG. 7 is a schematic view showing a lubrication apparatus 612 according to Embodiment 2 of the present invention. Embodiment 2 is different from Embodiment 1 in the communicating passage 67. Descriptions of the same parts as in Embodiment 1 will be omitted. The same applies to the following other embodiments. The communicating passage 67 according to Embodiment 2 is connected to the driving chamber 51 to be open in the vicinity of an engagement portion 30 of the drive gear 31 and the cam gear 33. In addition, a one-way valve 91 is provided in the communicating passage 67 to allow oil to flow in only one direction from the crank chamber 23 to the driving chamber 51. With this configuration, oil is supplied directly to the vicinity of the engagement portion 30 of the drive gear 31 and the cam gear 33, so that it is possible to prevent more effectively the drive gear 31 and the cam gear 33 from being damaged.

Embodiment 3

[The Structure of a Lubrication Apparatus 613 According to Embodiment 3 of the Present Invention]

Figure 8:
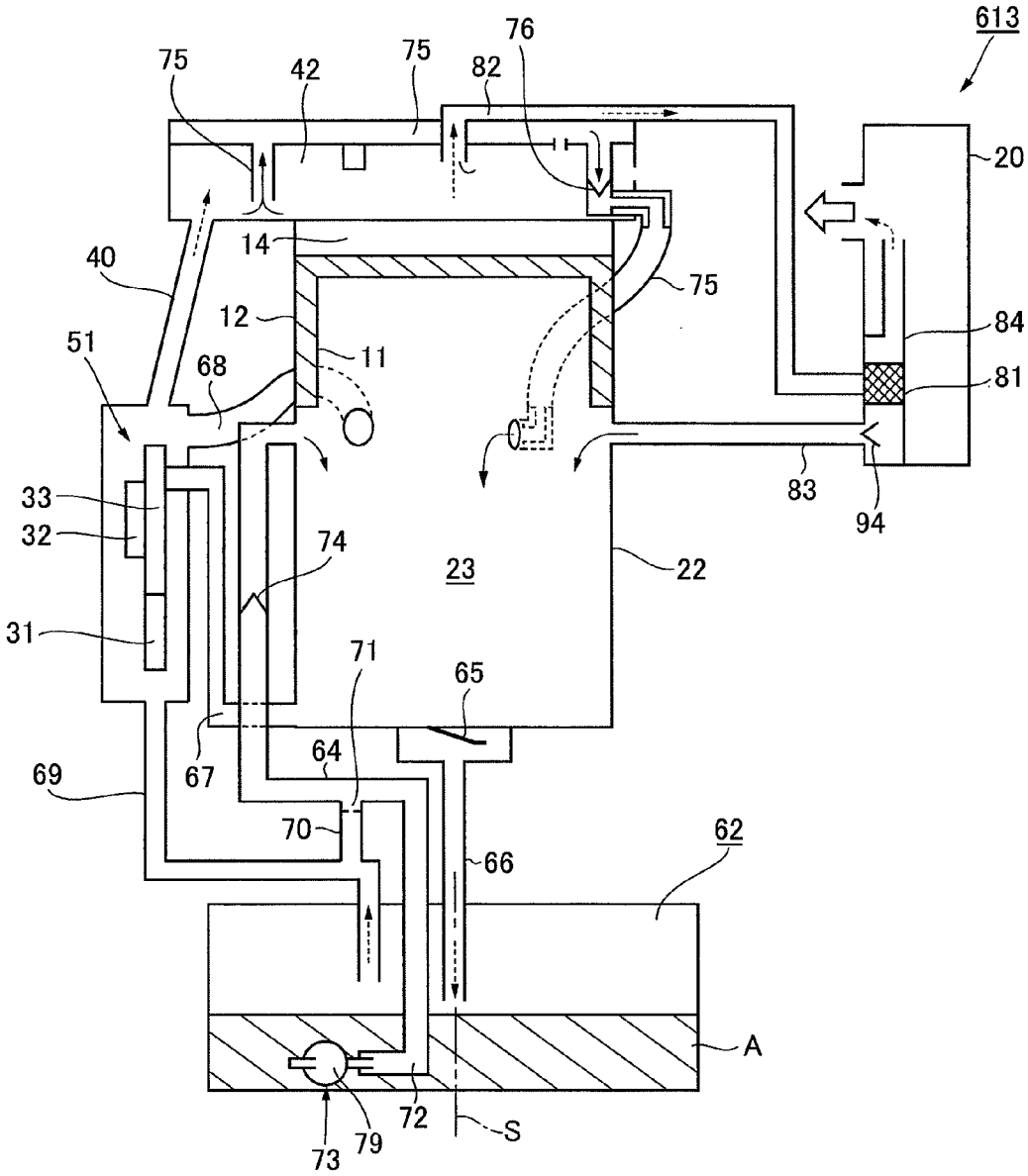
FIG. 8 is a schematic view showing a lubrication apparatus according to Embodiment 3 of the present invention.
Figure 9:
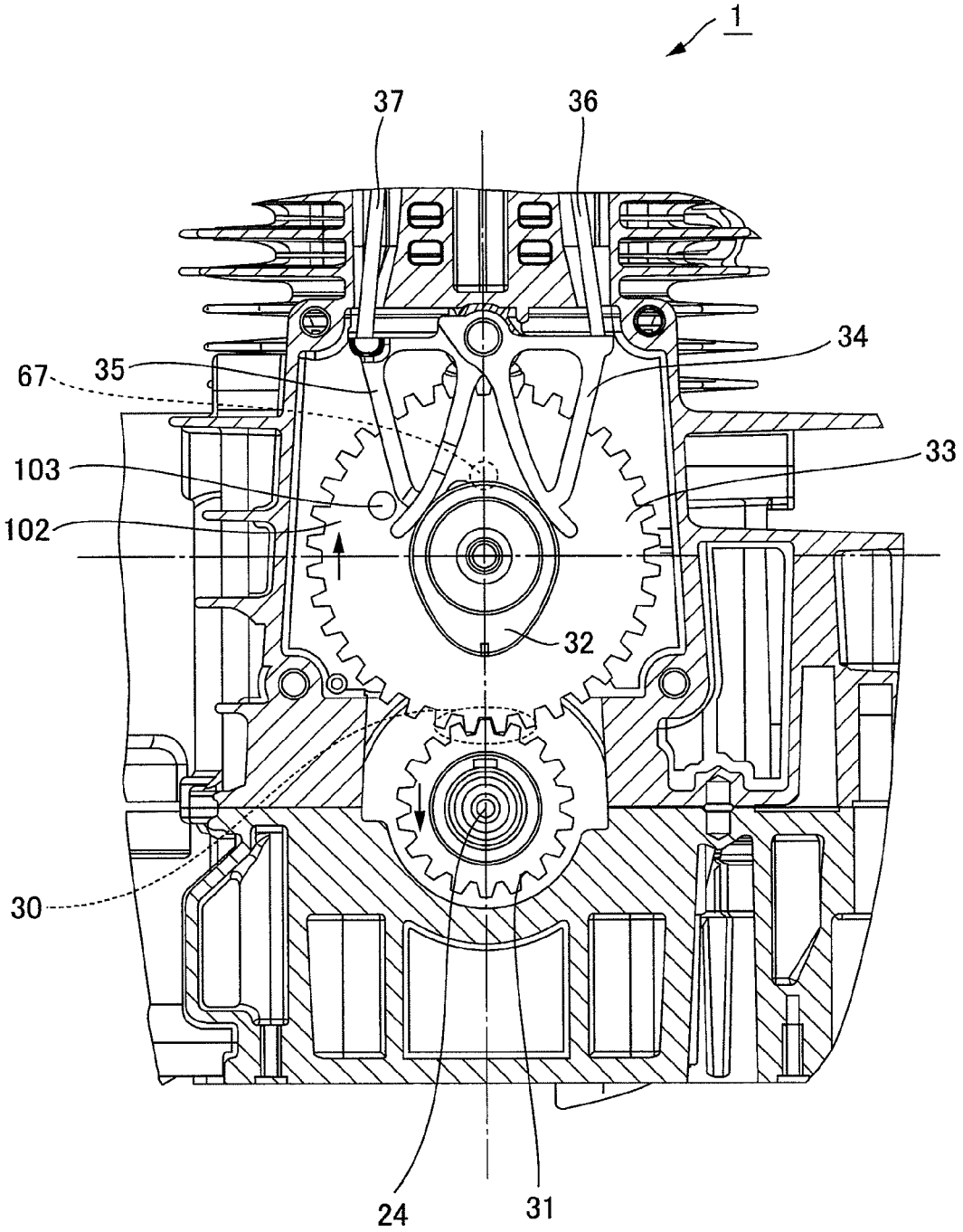
FIG. 9 is a partial cross-sectional view showing the four-stroke engine according to Embodiment 3 of the present invention.

FIG. 8 is a schematic view showing a lubrication apparatus 613 according to Embodiment 3 of the present invention. Embodiment 3 is different from Embodiment 1 and Embodiment 2 in the communicating passage 67. With the present embodiment, the communicating passage 67 and the cam gear 33 constitute an on-off valve. As shown in FIG. 9, a through-hole 103 is formed in the gear wheel 102 of the cam gear 33, and overlaps the opening of the communicating passage 67, so that the crank chamber 23 and the driving chamber 51 communicate with one another. The communicating passage 67 opens in the position enclosed by the cam 32, the cam follower 34 and the cam follower 35 in the vicinity of the outer periphery of the cam 32. In addition, the through-hole 103 is disposed in one position to communicate with the driving chamber 51 when the piston 11 moves from the top dead center to the bottom dead center just after the combustion chamber 14 ignites. With this configuration, it is possible to forcefully push the oil out of the crank chamber 23 to the driving chamber 51. Then, the oil is supplied directly to the connection of the cam 32 and the cam followers 34 and 35 to improve the lubrication performance. Due to the centrifugal force of the rotation of the cam 32 and the gravity, the oil adhering to the cam 32 moves to the outer periphery of the gear wheel 102 having a larger diameter than the cam 32 and lubricates the engagement portion 30 of the cam gear 33 and the drive gear 31.

Embodiment 4

[The Structure of a Lubrication Apparatus 614 According to Embodiment 4 of the Present Invention]

Figure 10:
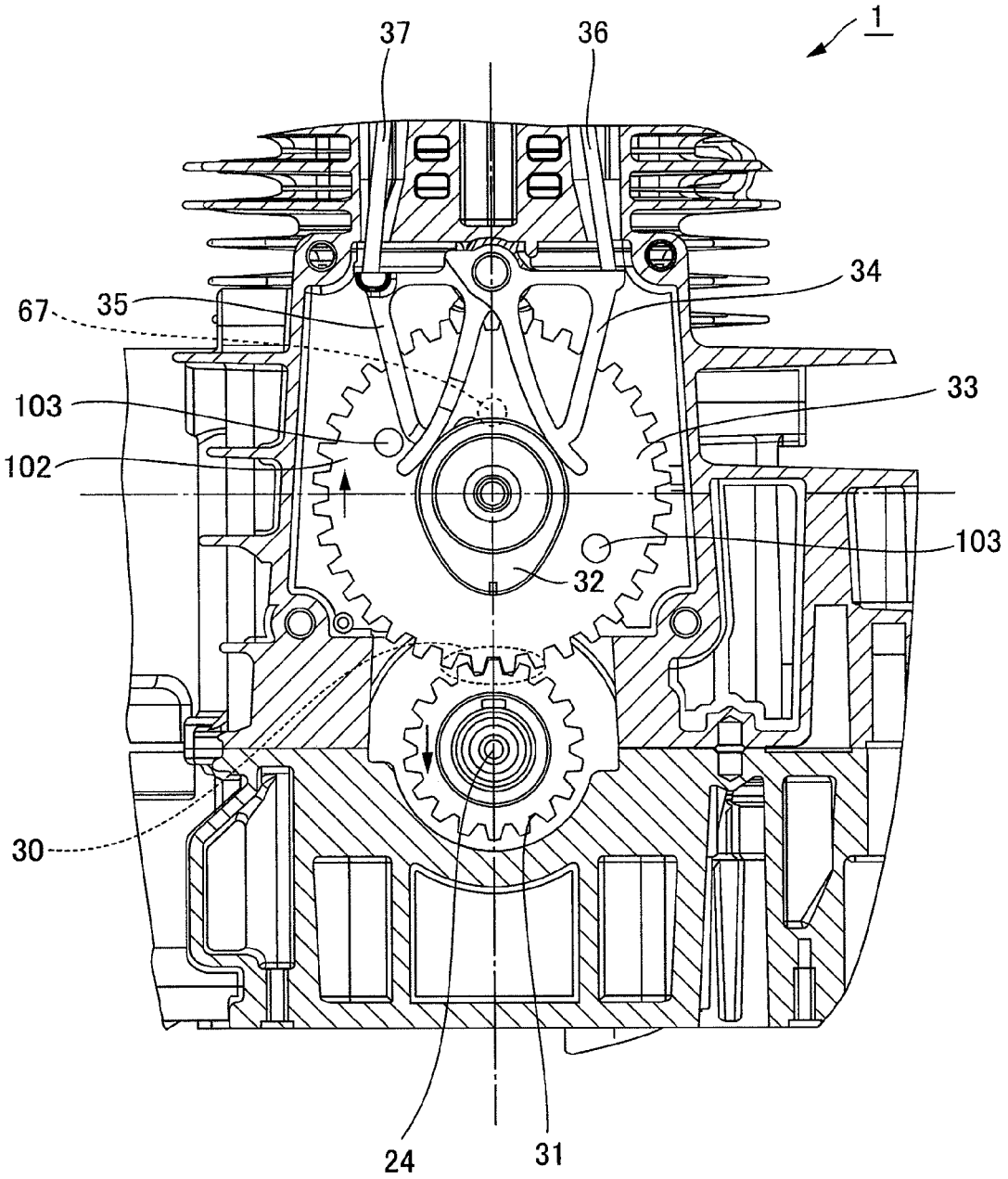
FIG. 10 is a partial cross-sectional view showing the four-stroke engine according to Embodiment 4 of the present invention.

FIG. 10 is a schematic view showing a lubrication apparatus 614 according to Embodiment 4 of the present invention. Embodiment 4 is different from Embodiment 3 in the through-hole 103 of the cam gear 33. With Embodiment 4, the communicating passage 67 has two through-holes 103 to communicate with the driving chamber 51 when the piston 11 moves from the top dead center to the bottom dead center.

With this configuration, it is possible to push a large amount of oil out of the crank chamber 23 to the driving chamber 51.

<Examples of the Use in a Working Machine>

FIG. 11 shows a concrete cutter 110 that is an exemplary working machine equipped with the four-stroke engine 1 according to each embodiment of the present invention. The concrete cutter 110 has a front grip 111, a back grip 112, and a cutter part 113 in the front, which is a working part. To supply fuel such as gasoline, a fuel tank cap 114 exposed to the outside is opened to fill a fuel tank 19 with fuel. To supply lubricating oil, an oil tank cap 115 exposed to the outside is opened to fill the oil tank 62 with lubricating oil. The four-stroke engine 1 is started by the recoil starter 28. The engine output is controlled by operating the throttle lever 116 provided in back grip 112. The rotation of the engine is transmitted to the cutter part 113. By operating the front grip 111 and the back grip 112, the cutter part 113 moves up and down. The cutter part 113 is pushed down to a road surface and so forth at work.

FIG. 12 shows a mist blower 121 that is an exemplary backpack working machine equipped with the four-stroke engine 1 according to each embodiment of the present invention. The mist blower 121 has a blower 122, a blower pipe 123, a chemical liquid tank 124, a liquid supply pipe 125 and a nozzle 126. The blower 122 is driven by the four-stroke engine 1 and sends air to the blower pipe 123. The nozzle 126 is provided on the front end of the blower pipe 123 and is connected to the chemical liquid tank 124 via the liquid supply pipe 125. The chemical liquid accumulated in the chemical liquid tank 124 is supplied to the nozzle 126 via the liquid supply pipe 125 and sprayed together with the air sent from the blower pipe 123. The mist blower 121 is equipped with a pair of shoulder straps 127 and carried on the user's back by means of the shoulder straps 127. The mist blower 121 is carried on the user's back when used. A liquid supply cock 128 is provided in the middle of the liquid supply pipe 125 to open and close the liquid supply pipe 125. In addition, by operating the throttle lever 116 to control the engine output, the supplied air flow is controlled.

The four-stroke engine 1 according to the present invention may be mounted in other portable working machines, such as an earth drill and a brash cutter. In addition, the four-stroke engine 1 may be mounted in other backpack working machines, such as a backpack blower, a sprayer, a duster and a backpack brush cutter. The present invention is applicable to an engine having a high power displacement of 50 cc or more, and is particularly advantageous when used in a portable working machine and a backpack working machine. Here, the above-mentioned working machines are illustrative only, and it is by no means limiting. The present invention is applicable to an electric generator to light a floodlight, which is driven by a four-stroke engine, and is particularly advantageous when the electric generator is held by the hands or carried on the back. Moreover, in addition to a portable or backpack working machine, the four-stroke engine 1 according to the present invention is applicable to a cutter for a machine tool that needs to change the direction of the tool at work. In this case, the effects of the present invention can be produced when the direction of the four-stroke engine 1 is changed depending on the direction of the tool.

Effects of the Embodiments

The above-described embodiments can produce the following effects.

Effect 1: The crank chamber 23 and the driving chamber 51 are connected to one another via the communicating passage 67. Therefore, it is possible to supply a sufficient amount of oil from the crank chamber 23 to the driving chamber 51. As a result, it is possible to prevent the drive gear 31, the cam gear 33, the cam follower 34 and the cam follower 35 accommodated in the driving chamber 51 from not being sufficiently lubricated. In addition, the driving chamber 51 is connected to the rocker chamber 42, and the rocker chamber 24 is connected to the crank chamber 23. Therefore, it is possible to lubricate the intake valve 17 and the exhaust valve 18 accommodated in the driving chamber 51. Moreover, the driving chamber 51 and the crank chamber 23 communicate with one another via the return passage 68 only when the piston 11 is located in the vicinity of the top dead center. Therefore, it is possible to supply the excess oil remaining in the driving chamber 51 to the crank chamber 23. Accordingly, oil is not oversupplied from the driving chamber 51 to the rocker chamber 42 because the excess oil is supplied from the driving chamber 51 to the crank chamber 23. Then, the rocker chamber 42 having no excess oil is connected to the gas-liquid separator 81, and therefore oil is not oversupplied to the gas-liquid separator 81. Consequently, it is possible to prevent oil from being consumed quickly. Here, although the OHV four-stroke engine 1 has been explained through the embodiments, the OHC four-stroke engine 1 is possible. In this case, a configuration is possible where a drive pulley is provided instead of the drive gear 31 and the cam 32 is provided in the rocker arm 42, and then the cam 32 is driven by the drive pulley through a belt.

Effect 2: The communicating passage 67 that connects between the driving chamber 51 and the crank chamber 23 is connected to the lower part of the crank chamber 23. By this means, it is possible to supply a sufficient amount of oil from the crank chamber 23 to the driving chamber 51. Therefore, it is possible to prevent the drive gear 31, the cam gear 33, the cam follower 34 and the cam follower 35 accommodated in the driving chamber 51 from not being sufficiently lubricated.

Effect 3: The rocker chamber 42 and the crank chamber 23 are connected to one another via the direct passage 75. The direct passage 75 and the crank chamber 23 communicate with one another only when the piston 11 is located in the vicinity of the top dead center. Therefore, even if excess oil remains in the rocker chamber 42, it is possible to effectively supply the oil from the rocker chamber 42 to the crank chamber 23, and consequently prevent excess oil from remaining in the rocker chamber 42. Oil is not oversupplied to the gas-liquid separator 81 because excess oil does not remain in the rocker chamber 42. Therefore, it is possible to prevent oil from being consumed quickly.

Effect 4: The gas-liquid separator 81 is connected to the crank chamber 23 via the reflux passage 83. The reflux passage 83 and the crank chamber 23 communicate with one another only when the piston 11 is located in the vicinity of the top dead center, and the oil separated in the gas-liquid separator 81 is supplied to the crank chamber 23. This allows the oil to be efficiently supplied from the gas-liquid separator 81 to the crank chamber 23. Therefore, it is possible to prevent oil from being consumed quickly.

Effect 5: The lower part of the driving chamber 51 communicates with the oil tank 2. Therefore, even if excess oil remains in the driving chamber 51, it is possible to return the oil to the oil tank 62. This prevents the oil from being oversupplied from the driving chamber 51 to the rocker chamber 42.

Effect 6: The cam 32 is provided in the driving chamber 51 with high lubrication performance, so that it is possible to prevent the cam 32 from being damaged. As a result, it is possible to use the four-stroke engine 1 without problem for a long period of time.

Effect 7: The drive gear 31, the cam gear 33, the cam followers 34 and 35, and the push rods 36 and 37 are made of synthetic resin. By this means, it is possible to reduce the four-stroke engine 1 in weight. In addition, by combining the effect 7 with the features of the effect 6, it is possible to prevent the valve operating members made of synthetic resin from being damaged.

Effect 8: In the lubrication apparatus 612 according to Embodiment 2, the communicating passage 67 is open in the driving chamber 51 in the vicinity of the engagement portion 30. Therefore, it is possible to prevent more effectively the drive gear 31 and the cam gear 33 from being damaged.

Effect 9: In the lubrication apparatus 613 according to Embodiment 3 and the lubrication apparatus 614 according to Embodiment 4, the communicating passage 67 is open in the driving chamber 51 in the vicinity of the outer periphery of the cam 32. Therefore, it is possible to prevent the cam 32 and the cam followers 34 and 35 from being damaged. Then, the cam gear 33 has a greater gear wheel 102 than the cam 32. Therefore, the oil adhering to the vicinity of the outer periphery of the cam 32, which is rotating, can easily flow into the engagement portion 30, so that it is possible to also prevent the engagement portion 30 of the drive gear 31 and the cam gear 33 from being damaged.

Effect 10: The crank chamber 23 and the driving chamber 51 communicate with one another via the communicating passage 67 when the piston 11 moves to the bottom dead center while the oil supply passage 64, the direct passage 75 and the reflux passage 83 are closed by the piston 11. This allows a large amount of oil to be supplied from the crank chamber 23 to the driving chamber 51. Therefore, it is possible to prevent the cam 32, the cam followers 34 and 35, and the push rods 36 and 37 from being damaged quickly. Here, another configuration is possible where first, the oil supply passage 64, the direct passage 75 and the reflux passage 83 are closed by the piston 11, and after that, the return passage 68 is closed. With this configuration, air is first sent adequately from the crank chamber 23 to the driving chamber 51, and then the oil is forcefully pushed out via the communicating passage 67. Therefore, it is possible to adequately control the amount of oil to be supplied to the driving chamber 51.

Effect 11: In the lubrication apparatus 613 according to Embodiment 3, the communicating passage 67 and the driving chamber 51 communicate with one another when the piston 11 moves to the bottom dead center just after the combustion chamber 14 ignites. Therefore, it is possible to forcefully push the oil out of the crank chamber 23 to the driving chamber 51, and consequently prevent the drive gear 31, the cam gear 33, the cam followers 34 and 35, and the push rods 36 and 37 from being damaged quickly.

Effect 12: The through-hole 103 provided in the cam gear 33 overlaps the communicating passage 67, so that the crank chamber 23 communicates with the driving chamber 51 via the communicating passage 67. Therefore, it is possible to realize Embodiment 3 without increasing the number of components, and consequently improve the lubrication performance as described in Effect 11 while reducing the four-stroke engine 1 in weight. Here, the through-hole 103 and the gear wheel 102 of the cam gear 33 do not always need to have high sealing performance. It is possible to produce a full effect in adherence with the spirit of the present invention as long as the flow resistance of the oil flowing between the crank chamber 23 and the driving chamber 51 via the communicating passage 67 varies significantly according to the opening and closing of the communicating passageway 67 in connection with the through-hole 103. Here, with Embodiment 3, although there is only one through-hole 103, the lubrication performance in the driving chamber 51 can be increasingly improved by providing two through-holes like in Embodiment 4.

Effect 13: In addition to the configuration described in Effect 12, the communicating passage 67 overlaps the through-hole 103 at the position in which the communicating passage 67 is enclosed by the cam 32 and the cam followers 34 and 35, so that the crank chamber 23 and the driving chamber 51 communicate with one another via the communicating passage 67. Therefore, it is possible to supply a larger amount of oil to prevent the cam 32 and the cam followers 34 and 35 from being damaged quickly.

Effect 14: In the lubrication apparatus according to each embodiment of the present invention, the driving chamber 51 and the crank chamber 23 are connected to one another via the communicating passage 67. Therefore it is possible to supply a sufficient amount of oil from the crank chamber 23 to the driving chamber 51. Therefore, it is possible to prevent the drive gear 31, the cam gear 33 and the cam followers 34 and 35 from not being sufficiently lubricated. Further, it is possible to prevent the cam 32 that especially needs to be lubricated, from being worn. In addition, the driving chamber 51 and the crank chamber 23 communicate with one another via the return passage 68 only when the piston 11 is located in the vicinity of the top dead center. Therefore, it is possible to supply the excess oil remaining in the driving chamber 51 to the crank chamber 23. With this configuration, it is possible to flow oil through the crank chamber 23, the communicating passage 67, the driving chamber 51, the return passage 68 and the crank chamber 23 in this order to form one oil circulating route. This oil circulating route allows a sufficient amount of oil to flow between the crank chamber 23 and the driving chamber 51. Therefore, it is possible to ensure the performance of lubricating the cam 32 accommodated in the driving chamber 51. Although the driving chamber 51 and the rocker chamber 42 are connected to one another, oil is not oversupplied from the driving chamber 51 to the rocker chamber 42 by the action of the above-described oil circulating route. The valve operating members accommodated in the rocker chamber 42 do not need a higher lubrication performance than for the cam 32. Therefore, it is possible to also ensure the performance of lubricating the valve operating members accommodated in the rocker chamber 42. In this way, the amount of oil to be supplied can be controlled individually for each of the driving chamber 51 and the rocker chamber 42. This improves the quality of the lubrication apparatus for the four-stroke engine 1.

Effect 15: The rocker chamber 42 and the crank chamber 23 are connected to one another via the direct passage 75. The direct passage 75 and the crank chamber 23 communicate with one another only when the piston 11 is located in the vicinity of the top dead center. Therefore, it is possible to improve the efficiency of sucking the oil from the rocker chamber 42 into the crank chamber 23. With this configuration, oil flows through the crank chamber 23, the communicating passage 67, the driving chamber 51, the push rod guide 40, the rocker chamber 42, the direct passage 75 and the crank chamber 23 in this order to form the different oil circulating route than the above-described one. This circulating route allows oil to smoothly pass through the rocker chamber 42, so that the oil in the rocker chamber 42 is smoothly replaced. In this way, the oil in the rocker chamber 42 is smoothly replaced, and therefore it is possible to ensure the performance of lubricating the valve operating members accommodated in the rocker chamber 42.

Effect 16: Oil is supplied under pressure from the crank chamber 23 to the valve operating chamber 51 via the communicating passage 67, using the positive pressure created in the process in which the pressure in the crank chamber 23 changes from the lower limit to the upper limit. By this means, it is possible to supply a sufficient amount of oil from the crank chamber 23 to the valve operating chamber 51. Then, by using the negative pressure in the crank chamber 23 at approximately the lower limit, it is possible to suck a sufficient amount of oil from the driving chamber 51 into the crank chamber 23. With this configuration, it is possible to efficiently provide the oil circulating route described in Effect 14.

Effect 17: By using the negative pressure in the crank chamber 23 at approximately the lower limit, it is possible to suck a sufficient amount of oil from the rocker chamber 42 to the crank chamber 23. With this configuration, it is possible to efficiently provide the oil circulating route described in Effect 15.

Although the preferred embodiments of the present invention have been described, the present invention is not limited to them. It will be understood that various modifications and alterations may be made without departing from the spirit and scope of the invention.

The invention claimed is:

1. A four-stroke engine configured to lubricate driving parts including a crankshaft and valve operating members while circulating oil, using pressure fluctuation in a crank chamber, the pressure fluctuation being caused by reciprocating motion of a piston, the four-stroke engine comprising:

an intake valve and an exhaust valve configured to open and close a combustion chamber;

a rocker chamber configured to accommodate the intake valve and the exhaust valve;

a cam to drive the intake valve and the exhaust valve;

cam driving parts to drive the cam;

a driving chamber configured to accommodate the cam driving parts;

a tank to accumulate oil therein; and a gas-liquid separator configured to separate blowby gas from oil used for lubrication, wherein:

the cam driving parts move with rotation of the crankshaft;

the driving chamber and the rocker chamber are connected to one another;

the rocker chamber is connected to the crank chamber and the gas-liquid separator;

the oil accumulated in the tank is sucked up into the crank chamber and circulated through each part of the four-stroke engine;

the crank chamber and the driving chamber are connected to one another via a communicating passage and a return passage; and the crank chamber and the driving chamber connected to one another via the return passage communicate with one another only when the piston is located in a vicinity of a top dead center.

2. The four-stroke engine according to claim 1, wherein the communicating passage is connected to a lower part of the crank chamber.

3. The four-stroke engine according to claim 1, wherein:

the rocker chamber and the crank chamber are connected to one another via a direct passage; and the rocker chamber and the crank chamber connected to one another via the direct passage communicate with one another only when the piston is located in a vicinity of a top dead center.

4. The four-stroke engine according to claim 1, wherein:

the gas-liquid separator is connected to the crank chamber via a reflux passage; and the gas-liquid separator and the crank chamber connected to one another via the reflux passage communicate with one another only when the piston is located in a vicinity of a top dead center, and oil separated in the gas-liquid separator is supplied to the crank chamber.

5. The four-stroke engine according to claim 1, wherein the tank communicates with a lower part of the driving chamber.

6. The four-stroke engine according to claim 1, wherein the cam is provided in the driving chamber.

7. The four-stroke engine according to claim 6, wherein:

the cam driving parts are formed by a pair of gear parts made of synthetic resin, a first gear part being directly connected to the crankshaft, and a second gear part being formed integrally with the cam.

8. The four-stroke engine according to claim 7, wherein the communicating passage is open in the driving chamber in the vicinity of an engagement portion of the gear parts.

9. The four-stroke engine according to claim 7, wherein:

cam followers contact an outer periphery of the cam;

push rods contact the cam followers;

the intake valve and the exhaust valve are driven by converting rotational motion of the cam into reciprocating motion of the push rods;

the second gear part has a larger gear wheel than the cam; and the communicating passage is open in the driving chamber in a vicinity of an outer periphery of the cam.

10. The four-stroke engine according to claim 9, wherein:

the oil is sucked up from the tank into the crank chamber via an oil supply passage;

oil remaining in the rocker chamber is supplied from the rocker chamber to the crank chamber via a direct passage;

oil separated in the gas-liquid separator is supplied to the crank chamber via a reflux passage;

the tank and the crank chamber connected to one another via the oil supply passage communicate with one another only when the piston is located in a vicinity of a top dead center;

the rocker chamber and the crank chamber connected to one another via the direct passage communicate with one another only when the piston is located in the vicinity of the top dead center;

the gas-liquid separator and the crank chamber connected to one another via the reflux passage communicate with one another only when the piston is located in the vicinity of the top dead center; and the crank chamber and the driving chamber connected to one another via the communicating passage communicate with one another when the piston moves to a bottom dead center while the oil supply passage, the direct passage and the reflux passage are closed by the piston.

11. The four-stroke engine according to claim 10, wherein the crank chamber and the driving chamber connected to one another via the communicating passage communicate with one another when the piston moves to the bottom dead center just after the combustion chamber ignites.

12. The four-stroke engine according to claim 11, wherein:
a through-hole is formed in the second gear; and
the through-hole overlaps the communicating passage, so that the communicating passage and the driving chamber communicate with one another.

13. The four-stroke engine according to claim 12, wherein:
the communicating passage overlaps the through-hole in a position in which the communicating passage is enclosed by the cam and the cam followers thereby to communicate with the driving chamber.

14. A four-stroke engine configured to lubricate driving parts including a crankshaft and valve operating members while circulating oil, using pressure fluctuation in a crank chamber, the pressure fluctuation being caused by reciprocating motion of a piston, the four-stroke engine comprising:
an intake valve and an exhaust valve configured to open and close a combustion chamber;
a rocker chamber configured to accommodate the intake valve and the exhaust valve;
a cam to drive the intake valve and the exhaust valve; and
a driving chamber configured to accommodate the cam, wherein:
the driving chamber and the rocker chamber are connected to one another;
the crank chamber and the driving chamber are connected to one another via a communicating passage and a return passage;
the crank chamber and the driving chamber connected to one another via the return passage communicate with one another only when the piston is located in a vicinity of a top dead center; and
an oil circulating route is formed to circulate the oil between the crank chamber and the driving chamber.

15. The four-stroke engine according to claim 14, wherein:
the rocker chamber and the crank chamber are connected to one another via a direct passage; and
the rocker chamber and the crank chamber connected to one another via the direct passage communicate with one another only when the piston is located in the vicinity of the top dead center.

16. A four-stroke engine configured to lubricate driving parts including a crankshaft and valve operating members while circulating oil, using pressure fluctuation in a crank chamber, the pressure fluctuation being caused by reciprocating motion of a piston and, the four-stroke engine comprising:
an intake valve and an exhaust valve configured to open and close a combustion chamber;
a rocker chamber configured to accommodate the intake valve and the exhaust valve;
a cam to drive the intake valve and the exhaust valve; and
a driving chamber configured to accommodate the cam, wherein:
the driving chamber and the rocker chamber are connected to one another;
the crank chamber and the driving chamber are connected to one another via a communicating passage and a return passage;
a pressure in the crank chamber varies between a upper limit and a lower limit while the piston reciprocates once;
the oil is supplied under pressure from the crank chamber to the driving chamber via the communicating passage in a process in which the pressure in the crank chamber varies from the lower limit to the upper limit; and
the driving chamber and the crank chamber connected to communicate with one another when the pressure in the crank chamber is approximately the lower limit.

17. The four-stroke engine according to claim 16, wherein:
the rocker chamber and the crank chamber are connected to one another via a direct passage; and
the rocker chamber and the crank chamber connected to one another via the direct passage communicate with one another when the pressure in the crank chamber is approximately the lower limit.

* * * * *